US005934209A

United States Patent [19]

Mizuno

[11] Patent Number: 5,934,209

[45] Date of Patent: Aug. 10, 1999

[54] EMBROIDERY DATA PROCESSING APPARATUS SETTING ATTRIBUTE DATA FOR STITCHING CLOSED AREAS

[75] Inventor: Masahiro Mizuno, Nagoya, Japan

[73] Assignee: Brother Kogyo Kabushiki Kaisha, Nagoya, Japan

[21] Appl. No.: 08/990,733

[22] Filed: Dec. 15, 1997

[30] Foreign Application Priority Data

Dec. 27, 1996 [JP] Japan ..... 8-350274

[51] Int. Cl.[6] ..... D05B 21/00; D05C 5/02

[52] U.S. Cl. ..... 112/102.5

[58] Field of Search ..... 112/102.5, 470.06, 112/475.19, 456, 458; 364/470.09, 470.07

[56] References Cited

U.S. PATENT DOCUMENTS 5,179,520 1/1993 Hayakawa .
5,474,000 12/1995 Mizuno et al. ..... 112/102.5
5,740,057 4/1998 Futamura ..... 112/102.5
5,823,127 10/1998 Mizuno ..... 112/102.5

*Primary Examiner*—Peter Nerbun
*Attorney, Agent, or Firm*—Oliff & Berridge, PLC

[57] ABSTRACT

An embroidery data processing apparatus for generating stitch data capable of generating stitch data for stitching, with different stitching attributes, a plurality of closed areas formed by an embroidery area shape-defining outline that intersects itself. If an outline that defines the external shape of an embroidery area has a self-intersecting portion, a dividing device divides the outline into a plurality of segmental outlines using the self-intersecting portion as a boundary. For each of the segmental closed areas defined by the segmental outlines, a storage device stores a stitching attribute. A segmental stitch data generating device generates segmental stitch data for each segmental closed area on the basis of the corresponding stitching attribute stored by the storage device.

18 Claims, 10 Drawing Sheets

EMBROIDERY DATA PROCESSING APPARATUS SETTING ATTRIBUTE DATA FOR STITCHING CLOSED AREAS

BACKGROUND OF THE INVENTION

1. Field of Invention

The invention relates to an embroidery data processing apparatus capable of generating stitch data for stitching an embroidery area.

2. Description of the Related Art

Stitch data for stitching an embroidery was conventionally generated by a skilled person determining the position coordinates of needle location points for each stitch. An embroidery data processing apparatus has recently been developed, which is able to semi-automatically generate stitch data for embroideries by defining an embroidery body that designates the shape, position, size, stitching direction, stitch density, and the like of an area to be embroidered. Such apparatuses are now widely used.

In the case of an embroidery pattern wherein the outline that defines the shape of an area to be embroidered intersects itself, such as a pattern having the shape of an Arabic numeral "8", a plurality of closed areas to be embroidered are formed. However, the conventional embroidery data processing apparatus applies the same stitching attributes, such as stitch direction, thread density and the like, to all the closed areas defined by a single outline. That is, the closed areas defined by the single outline are to be stitched with the same stitching attributes. Since the conventional apparatus is unable to set stitching attributes separately for individual closed areas that are defined by a single outline, the apparatus requires a user to perform a time-consuming operation, that is, to prepare an area-defining outline separately for each closed area, if it is necessary or preferable to set different stitching attributes for different closed areas.

SUMMARY OF THE INVENTION

Accordingly, it is an object of the invention to provide an embroidery data processing apparatus capable of generating stitch data for stitching, with different stitching attributes, a plurality of closed areas formed by an embroidery area shape-defining outline that intersects itself.

According to the invention, there is provided an embroidery data processing apparatus for processing embroidery data for filling a closed area enclosed by an outline that defines a shape of an embroidery area, with stitches. The embroidery data processing apparatus includes a dividing device that, if the outline has a self-intersecting portion, divides the outline into a plurality of segmental outlines using the self-intersecting portion as a boundary. Furthermore, a storage device stores a stitching attribute of each of segmental closed areas defined by the plurality of segmental outlines. A segmental stitch data generating device generates segmental stitch data for each segmental closed area on the basis of the stitching attribute stored by the storage device.

If an outline defining the external shape of an embroidery area has a self-intersecting portion, the dividing device divides the outline into a plurality of segmental outlines using the self-intersecting portion as a boundary. For each of the segmental closed areas defined by the segmental outlines, the storage device stores a stitching attribute. The segmental stitch data generating device generates segmental stitch data for each segmental closed area on the basis of the corresponding stitching attribute stored by the storage device.

The embroidery data processing apparatus may further include a stitching attribute setting device that sets a stitching attribute separately for each segmental closed area. Thereby, it becomes possible to set different stitching attributes for the different segmental closed areas.

The embroidery data processing apparatus may further include a selecting device that selects at least one segmental closed area from the segmental closed areas. Thereby, it becomes possible to freely select a segmental closed area for setting or changing the stitching attribute.

The stitching attribute of each segmental closed area may include at least one of a line-portion stitching attribute for stitching along the segmental outline and an interior stitching attribute for stitching inside the segmental closed area. Thereby, it becomes possible to set the stitching attribute for stitching along a segmental outline and/or the stitching attribute for stitching inside the segmental closed area independently of each other.

The at least one of the line-portion stitching attribute and the interior stitching attribute may include at least one of a thread color attribute value that defines a color of a thread used for stitching, a stitching type attribute value that defines a type of stitching manner, and an attribute value characteristic of each type of stitching manner. Thereby, it becomes possible to designate in detail the manner of generating stitch data for stitching along a segmental outline and/or for stitching inside the segmental closed area.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
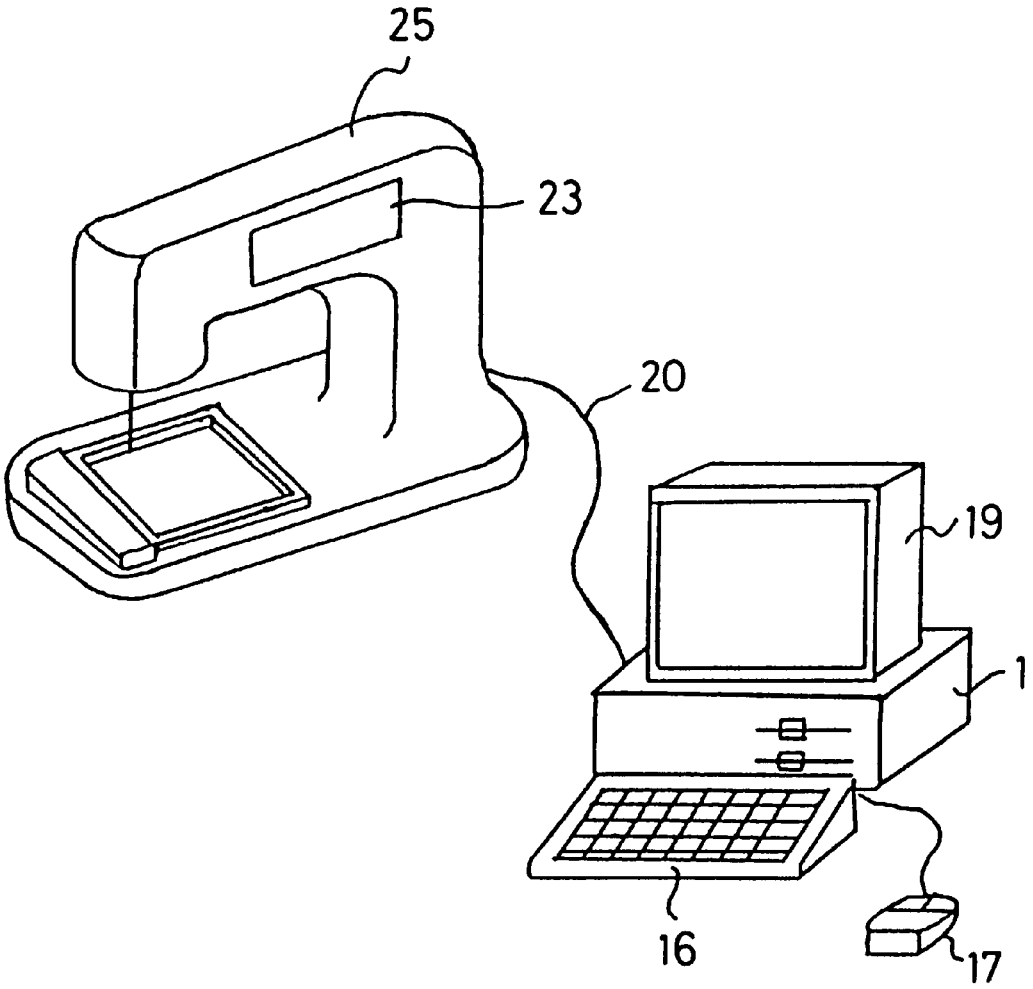
FIG. 1 is a perspective view of the overall arrangement of an embroidery sewing machine and an embroidery data processing apparatus according to an embodiment of the invention.

A preferred embodiment of the invention will be described in detail hereinafter with reference to the accompanying drawings.

An embroidery sewing machine used together with an embodiment of the embroidery data processing apparatus of the invention will be briefly described, although not detailed in the drawings. The embroidery sewing machine forms an embroidery pattern in a work cloth held by an embroidery frame disposed on a bed, by operating a horizontal motion mechanism to move the embroidery frame to predetermined positions indicated by the X-Y coordinate system provided specifically for the sewing machine while operating a sewing needle and a shuttle mechanism to stitch.

The horizontal motion mechanism, the needle bar and the like are controlled by a control device formed of a microcomputer and the like. The control device receives embroidering stitch (needle pierce) data that designates a displacement (needle pierce position) of the work cloth in the X and Y-directions for each stitch and, thereby, is able to automatically perform the embroidering operation. In this embodiment, the embroidery sewing machine is equipped with a communication device for receiving embroidery stitch data from an external device. An embroidery data processing apparatus of this embodiment has a function for generating such embroidery stitch data.

FIG. 1 shows the overall arrangement of a sewing machine and an embroidery data processing apparatus according to this embodiment. An embroidery sewing machine 25 is constructed to receive embroidery data from a personal computer 1 through a communication cable 20. The embroidery sewing machine 25 has a display 23 for displaying various messages, such as a message to instruct a user to change the embroidery thread to a different-color thread, and the like.

Figure 2:
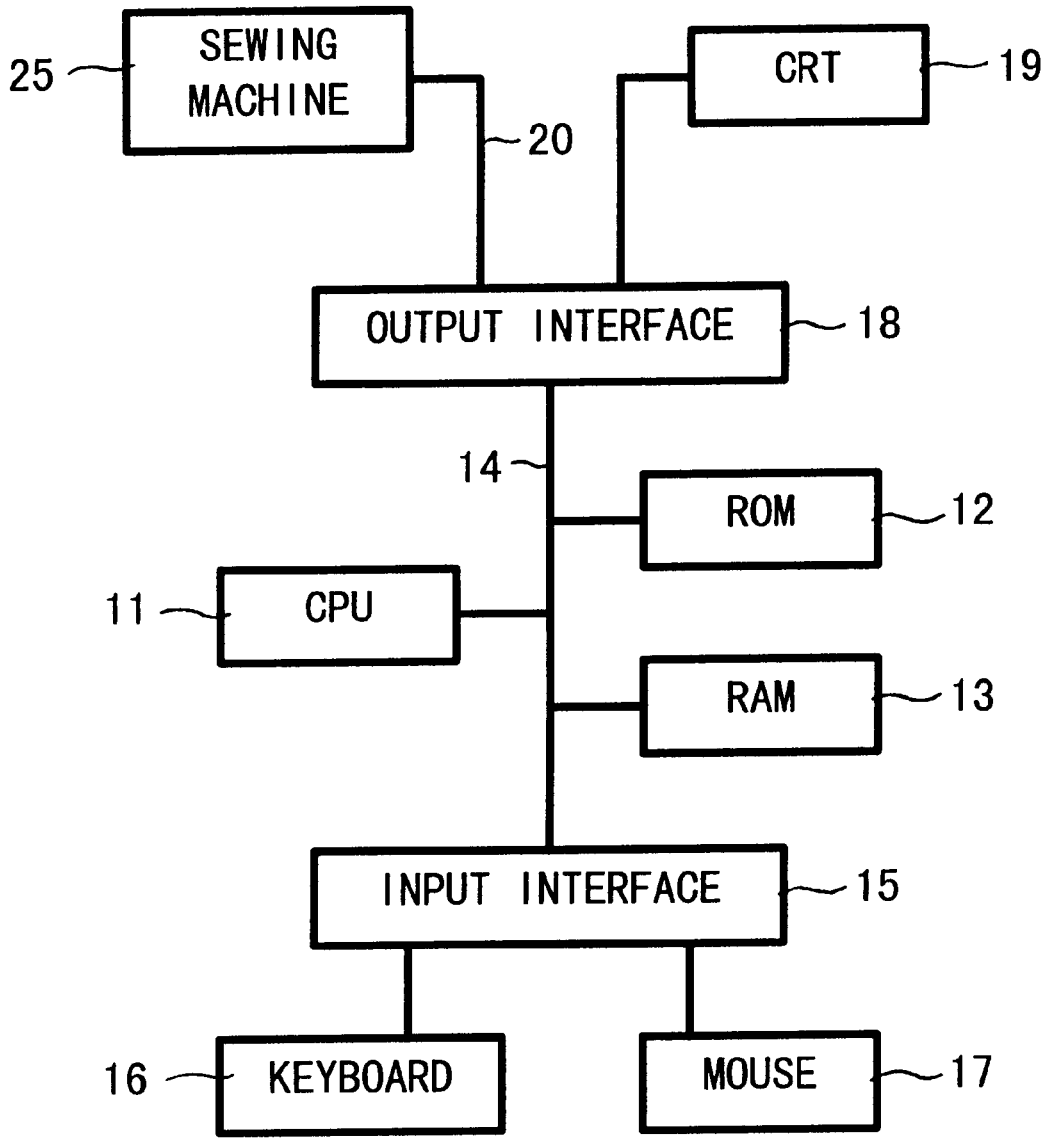
FIG. 2 is a block diagram illustrating the electrical arrangement of the embroidery data processing apparatus of the embodiment.

FIG. 2 illustrates the electrical arrangement of the embroidery data processing apparatus of this embodiment. The apparatus includes a central processing unit (CPU) 11, a read-only memory (ROM) 12, a random-access memory (RAM) 13, an input interface 15 and an output interface 18 which are interconnected by a bus 14. The CPU 11 performs control of the entire embroidery data processing apparatus while transmitting and receiving various data and signals. The ROM 12 stores programs and data for control of the embroidery data processing apparatus. The RAM 13 erasably stores data that are inputted from a keyboard 16 or an external storage device.

The embroidery data processing apparatus is equipped with a cathode-ray tube (CRT) display 19 connected to the output interface 18. The CRT display 19 displays various graphics indicating the shapes of embroidery patterns, various messages, and the like.

The keyboard 16 and a mouse 17 are connected to the CPU 11, via the input interface 15. The keyboard 16 has an arrangement of operating keys for a user to input instructions, such as selection of an operation, execution of an operation, and the like. The mouse 17 is a pointing device provided as a selecting device for, for example, producing or selecting an outline that defines an embroidery shape on the CRT display 19.

The communication cable 20 is connected to the embroidery data processing apparatus by the output interface 18. The embroidery data processing apparatus transmits generated embroidery data to the embroidery sewing machine 25 through the communication cable 20.

The operation of the embroidery data processing apparatus of this embodiment will be described with reference to the flowchart of FIG. 3. In the description below, it is assumed that stitch data is generated for filling with stitches the interior of the closed area defined by an outline L shown in FIG. 4A.

When the program stored in the ROM 12 for generating embroidery data is started, the CPU 11 extracts self-intersecting points of the outline in step S1. In the case of the outline L shown in FIG. 4A, two intersecting points A1, A2 are extracted.

Figure 4A:
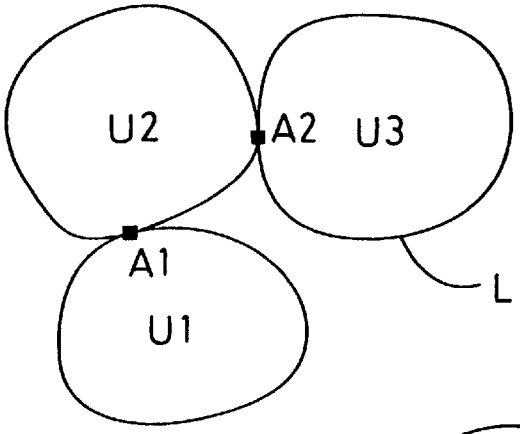
FIGS. 4A–4D illustrate a processing method for generating stitch data and an example of a selecting device according to the embodiment.
Figure 7:
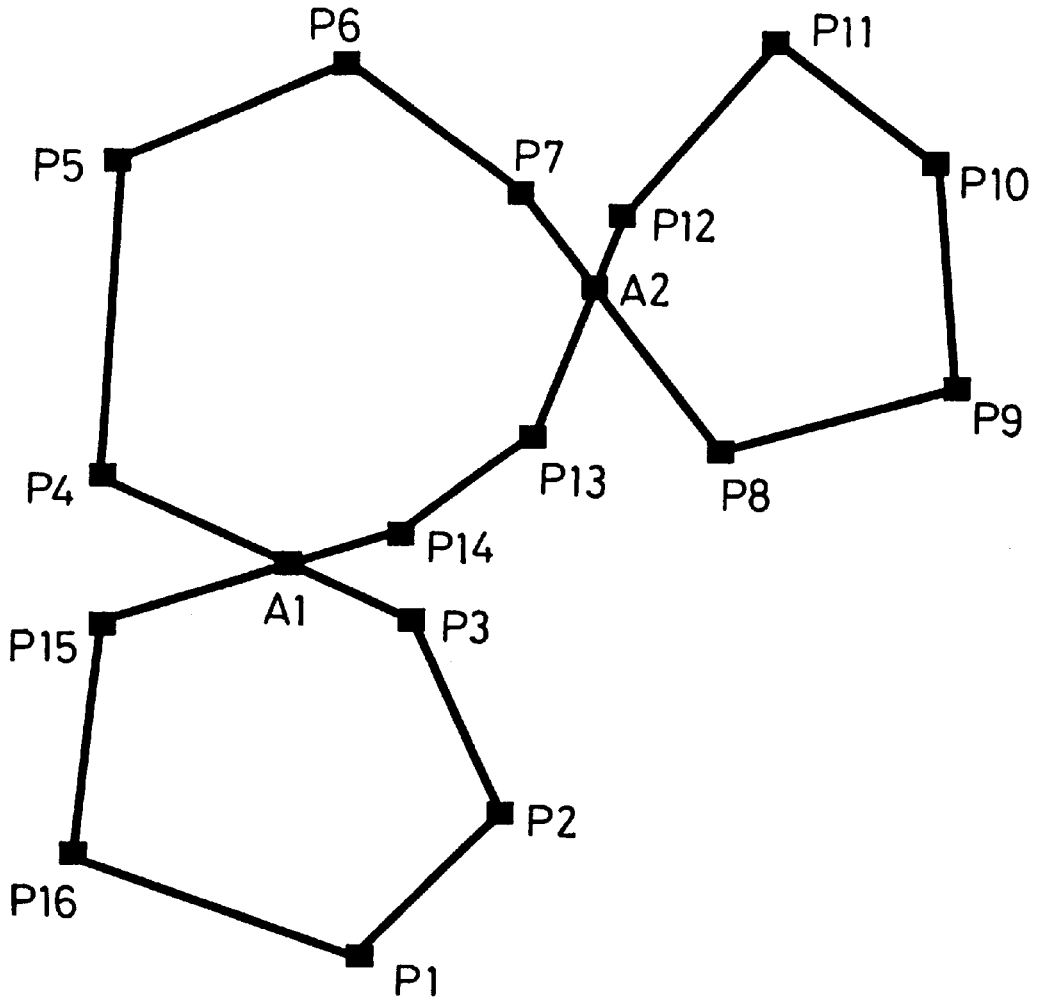
FIG. 7 shows an outline that defines a plurality of segmental closed areas, and points that define the outline.
Figure 8:
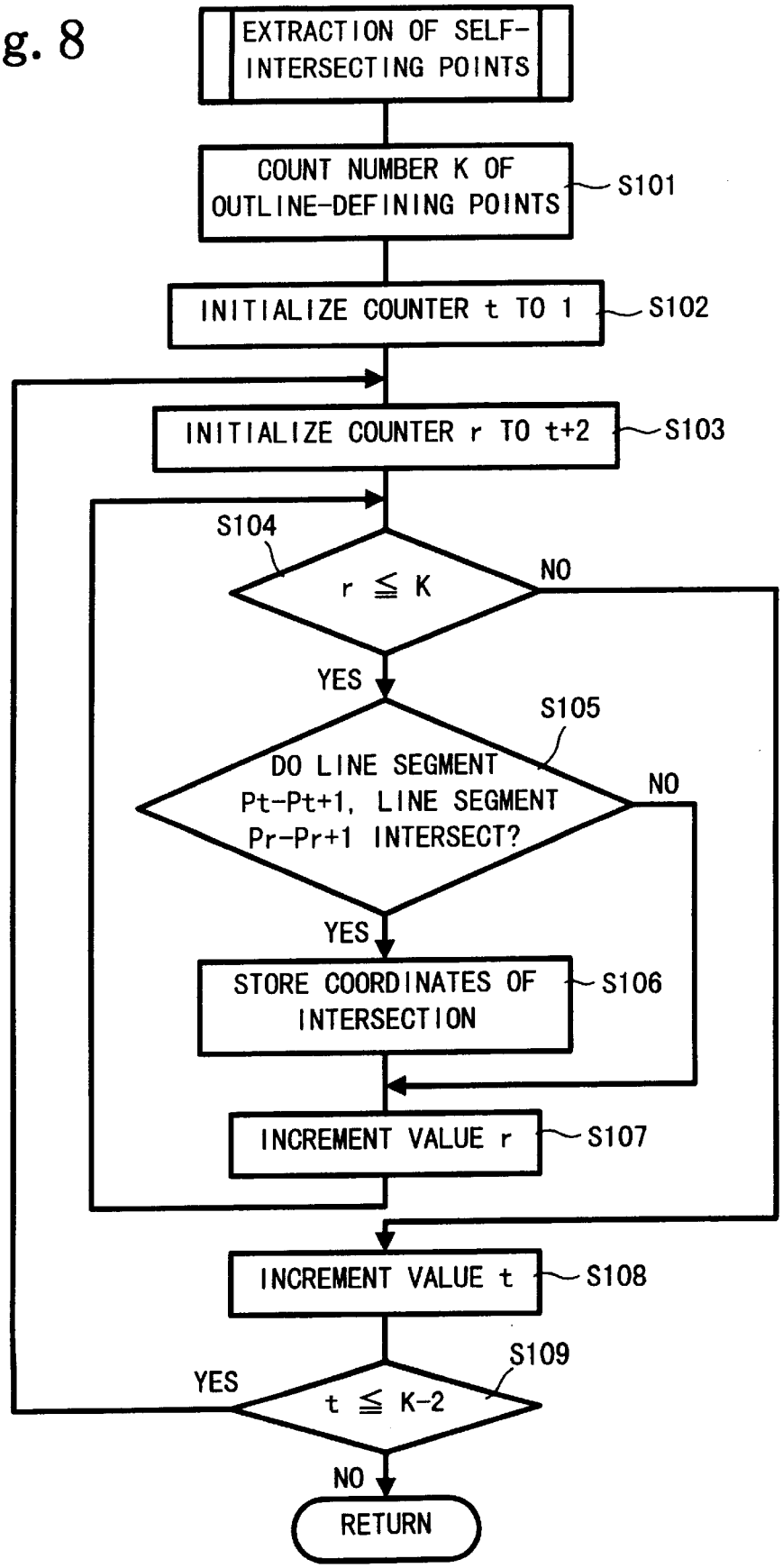
FIG. 8 is a flowchart illustrating an operation of extracting self-intersecting points.

The operation of extracting self-intersecting points in step S1 will be described in detail with reference to the flowchart of FIG. 8. It is assumed that the outline L shown in FIG. 4A is a bent outline, as shown in FIG. 7, formed by serially connecting outline-defining points P1–P16.

In step S101, the number K of points defining the outline L is counted. In the example shown in FIG. 7, the number K is 16.

In step S102, a counter t is initialized to 1.

In step S103, a counter r is initialized to t+2 (that is, 3 in this case).

In step S104, it is determined whether the value of the counter r is equal to or less than the number K of the outline-defining points. Since the value r is presently 3 and the number K is presently 16, the determination in step S104 is YES, and the operation proceeds to step S105.

In step S105, it is determined whether a line segment of Pt to Pt+1 and a line segment of Pr to Pr+1 intersect each other. In the present stage, it is determined whether the line segment of P1 to P2 and the line segment of P3 to P4 intersect. Because the line segment of P1–P2 and the line segment of P3–P4 do not intersect, as can be seen in FIG. 7, the determination in step S105 is NO, and the operation jumps to step S107.

In step S107, the value of the counter r is incremented (r=4). The operation subsequently returns to step S104. Similar processing is repeated until the value of the counter r exceeds the number K (=16) of the outline-defining points. When it is determined in step S104 that the counter value r has exceeded the number K (No in step S104), the operation proceeds to step S108.

In step S108, the value of the counter t is incremented (t=2).

Subsequently, in step S109, it is determined whether the value of the counter t is equal to or less than the value obtained by subtracting 2 from the number K of the outline-defining points. Since the value t presently equals 2 and the value (K−2) presently equals 14, the determination in step S109 is YES, and the operation returns to step S103.

A similar operation is continued until the value of the counter t becomes 3 and the value of the counter r becomes 14. Since the line segment P3–P4 and the line segment P14–P15 intersect, the determination in step S105 is YES, and the operation proceeds to step S106.

In step S106, the coordinates of the intersecting point between the line segment P3–P4 and the line segment P14–P15 are determined, and stored into the RAM 13. That is, the coordinates of the self-intersecting point A1 of the outline L shown in FIGS. 4A and 7 are extracted. The operation then proceeds to step S107 and continues processing.

When the value of the counter t becomes 7 and the value of the counter r becomes 12 after processing similar to that described above, the determination in step S105 is YES since the line segment P7–P8 and the line segment P12–P13 intersect. The operation then proceeds to step S106.

In step S106, the coordinates of the intersecting point between the line segment P7–P8 and the line segment P12–P13 are determined, and stored into the RAM 13. That is, the coordinates of the self-intersecting point A2 of the outline L shown in FIGS. 4A and 7 are extracted. The operation then proceeds to step S107.

Similar processing continues until the value of the counter t becomes 15. Since the value t (15) is now greater than the value (K−2) (that is, 14), the determination in step S109 is NO.

It is to be noted that when r=K, then pt+1 would be undefined, i.e. non-existent point P17 in this example. Thus, the routine uses P1 which is the next point on the outline as pt+1.

The extraction of self-intersecting points in the outline L is thus completed by the operation of steps S101–S109. The operation then goes to step S2 in FIG. 3.

Figure 3:
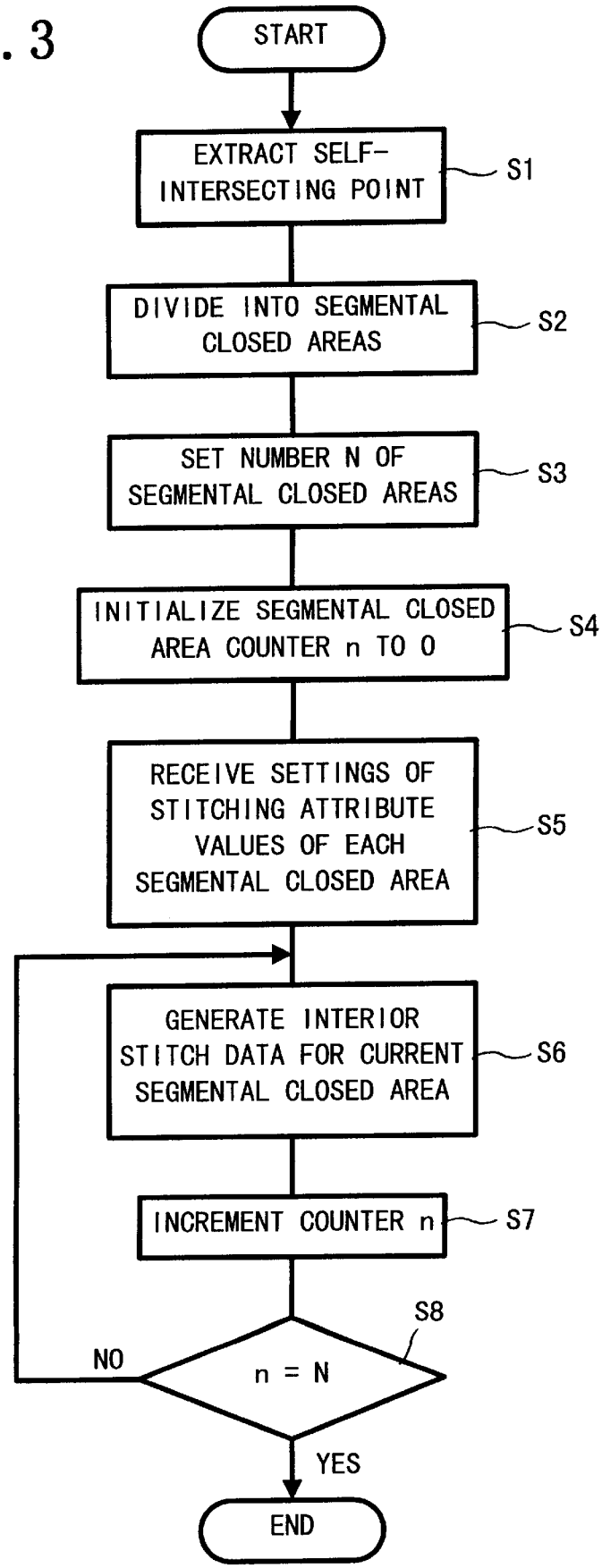
FIG. 3 is a flowchart illustrating an example of the stitch data generating operation performed by the embroidery data processing apparatus of the embodiment.
Figure 4B:
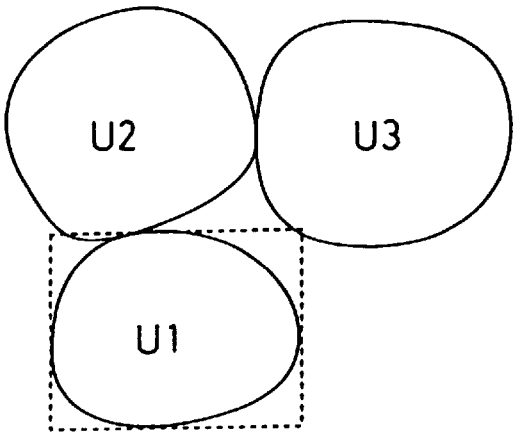
Figure 4C:
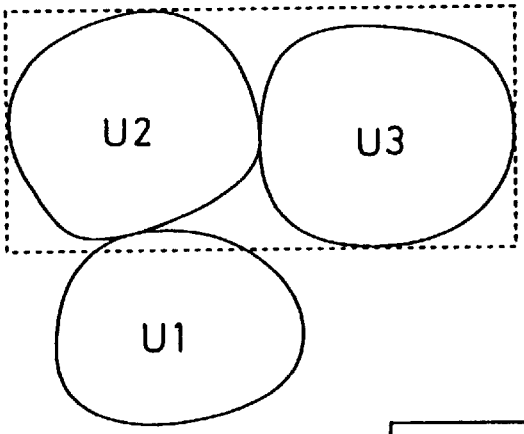

In step S2 in FIG. 3, the CPU 11 divides the outline L at the self-intersecting points A1, A2 into segmental outlines, and sets segmental closed areas U1, U2 and U3 enclosed by the segmental outlines as shown in FIGS. 4A–4C.

In step S3, the CPU 11 sets the total number N of segmental closed areas set in step S2, to 3.

Figure 9:
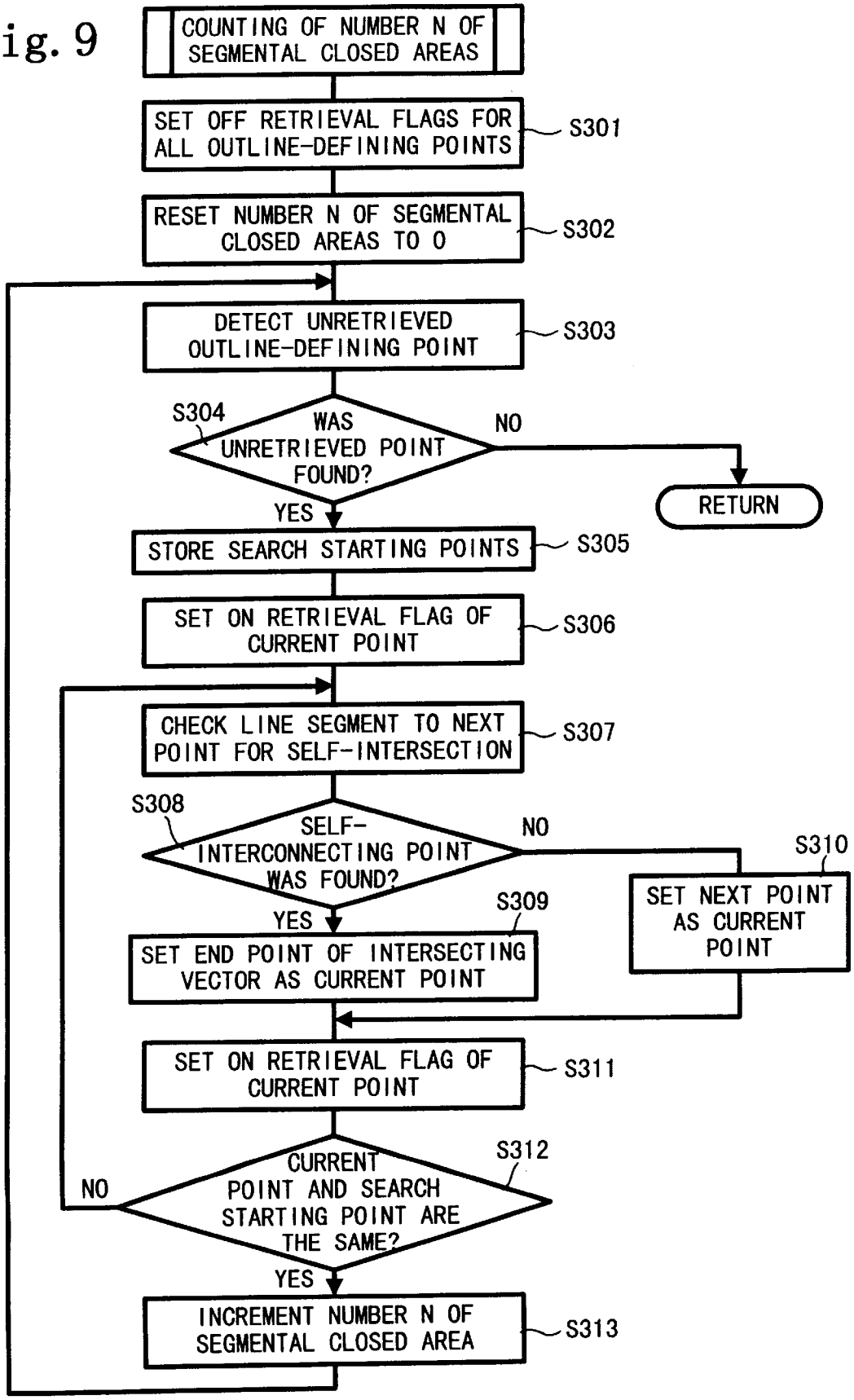
FIG. 9 is a flowchart illustrating an operation of counting the number of segmental closed areas.

The operation of counting the total number N of segmental closed areas of step S3 will be described in detail with reference to the flowchart of FIG. 9. It is assumed that the outline L shown in FIG. 4A is a bent outline formed by serially connecting outline-defining points P1–P16, as shown in FIG. 7.

In step S301, flags indicating retrieval of the individual points defining the outline L for self-intersection search are set to "OFF" (indicating unretrieved). A flag is set to "ON" when the corresponding outline-defining point is retrieved for self-intersection search in a later stage of the operation.

In step S302, the total number N of segmental closed areas is reset to 0.

In step S303, an unretrieved outline-defining point, that is, a point that has not been retrieved for self-intersection search, is searched for. Specifically, an outline-defining point with the corresponding flag being "OFF" is searched for, by serially checking the retrieval flags in the sequence of the flags of the points P1 to P16. In the present stage, the point P1 is first detected as an unretrieved outline-defining point.

In step S304, it is determined whether an unretrieved outline-defining point has been found in step S303. Since the point P1 was found as an unretrieved point and therefore extracted in step S303 in the present stage, the determination in step S304 is YES, and the operation proceeds to step S305.

In step S305, the outline-defining point retrieved in step S303 is stored into the RAM 13 as a search starting point for the purpose of counting the number of segmental closed areas. In the present stage, the point P1 is stored into the RAM 13 as a search starting point. The point P1 is treated as a current point for self-intersection search.

In step S306, the retrieval flag of the point P1, which is the current point, is set to "ON" (indicating retrieved).

In step S307, the line segment from the current point P1 to the next point P2 is checked for the presence of a self-intersecting point of the outline L.

In step S308, it is determined whether a self-intersecting point of the outline L was found in the line segment presently concerned in step S307. In the present stage, the determination in step S308 is NO because the line segment P1–P2 does not have a self-intersecting point of the outline L as shown in FIG. 7. The operation then goes to step S310.

In step S310, the point P2, which has been used as the next point, is set as a current point.

In step S311, the retrieval flag of the current point, that is, the point P2, is set to "ON" (indicating retrieved).

In step S312, it is determined whether the current point and the search starting point S are one and the same point. Because the current point P2 for the search and the search starting point P1 are not the same, the determination in step S312 is NO, and the operation returns to step S307.

Similar processing continues until the current and next points for search become the point P3 and the point P4, respectively. In step S307, the line segment P3–P4 is checked for the presence of a self-intersecting point of the outline L. Since the line segment P3–P4 has a self-intersecting point A1 of the outline L, as shown in FIG. 7, the presence of the self-intersecting point A1 is confirmed in step S307. The determination in step S308 therefore is YES, and the operation proceeds to step S309.

In step S309, the end point of the vector (line segment) intersecting with the presently-concerned line segment at the self-intersecting point of the outline L is set as a current point. In the present stage, the end point P15 of the vector P14–P15 intersecting the concerned line segment P3–P4 is set as a current point for the next search for a self-intersecting point, the decision rule being the point having the highest designation is selected.

In step S311, the retrieval flag of the current point P15 for search is set to "ON".

Because the current point P15 and the search starting point P1 are not the same, the determination in step S312 is NO, and the operation returns to step S307.

Similar processing continues until step S310 sets the point P1 as a current point for search, which occurs after the current and next points for search have been set to the point P16 and the point P1. In step S312, it is determined that the current point P1 for search and the search starting point P1 are the same point. The operation then proceeds to step S313.

In step S313, the number N of segmental closed areas (N=0) is incremented (to N=1). The operation then returns to step S303.

In step S303, an unretrieved outline-defining point is searched for. In the present stage, the point P4 is detected and extracted as an unretrieved point because the point P4 is the first point with the corresponding retrieval flag being "OFF" that is detected by serially checking the retrieval flags of outline-defining points in the sequence of the flags of points P1 toward P16.

In step S305, the point P4 is set as a search starting point.

Similar processing continues until the current and next points for search become the point P7 and the point P8, respectively. Since the line segment P7–P8 has a self-intersecting point A2 of the outline L, as shown in FIG. 7, the presence of the self-intersecting point A2 on the line segment P7–P8 is confirmed in step S307. The determination in step S308 therefore is YES, and the operation proceeds to step S309.

In step S309, the end point P13 of the vector P12–P13 intersecting the line segment P7–P8 is set as a new current point. The subsequent operation is continued.

Similar processing continues until the current and next points for search become the point P14 and the point P15, respectively. Since the line segment P14–P15 has the self-intersecting point A1 of the outline L as indicated in FIG. 7, the presence of the self-intersecting point A1 on the line segment P14–P15 is confirmed in step S307. The determination in step S308 therefore is YES, and the operation proceeds to step S309.

In step S309, the end point P4 of the vector P3–P4 intersecting the line segment P14–P15 is set as a new current point.

In step S312, it is determined that the current point P4 and the search starting point P4 are the same point. The operation then proceeds to step S313.

In step S313, the number N of segmental closed areas (N=1) is incremented (to N=2). The operation then returns to step S303.

In step S303, an unretrieved outline-defining point is searched for. In the present stage, the point P8 is detected and extracted as an unretrieved point because the point P8 is the first point with the corresponding retrieval flag being "OFF" that is detected by serially checking the retrieval flags of outline-defining points in the sequence of the flags of points P1 toward P16.

In step S305, the point P8 is set as a search starting point.

Processing similar to that described above continues until the current and next points for search become the point P12 and the point P13, respectively. In step S307, it is confirmed that the self-intersecting point A2 of the outline L is present on the line segment P12–P13 is confirmed. Therefore, the determination in step S308 is YES.

In step S309, the end point P8 of the vector P7–P8 intersecting the line segment P12–P13 is set as a new current point.

After the retrieval flag of the current point P8 is set to "ON" in step S311, it is determined in step S312 that the current point P8 and the search starting point P8 are the same point, and the operation proceeds to step S313.

In step S313, the number N of segmental closed areas (N=2) is incremented (to N=3). The operation then returns to step S303.

Because the retrieval flags of all the outline-defining points P1–P16 have been set to "ON", an unretrieved outline-defining point cannot be detected in step S303. Therefore, the determination in step S304 is NO, and the operation goes to step S4 in FIG. 3.

The number N (=3) of segmental closed areas is thus counted by the operation of steps S301 to S313.

In step S4 in FIG. 3, the value of a segmental closed area counter n is initialized to 0.

In step S5, the CPU 11 receives the settings of stitching attributes for the individual segmental closed areas U1, U2, U3 set in step S2. In this step, a user first selects the segmental closed area U1 of the segmental closed areas displayed in a portion of the screen of the CRT display 19, by selecting the segmental closed area U1 with the pointer of the mouse 17 and pressing a button of the mouse 17. A picture displayed in a portion of the screen of the CRT display 19 when the segmental closed area U1 is selected is shown in FIG. 4B, where a minimum rectangle enclosing the selected segmental closed area U1 is indicated by a broken line. Subsequently, the user sets stitching attributes of the selected segmental closed area U1 in a stitching attribute-setting dialog box (FIG. 5) displayed in another potion of the screen of the CRT display 19.

The stitching attributes will be described. The stitching attributes include line-portion stitching attributes for stitching along a segmental outline that defines a segmental closed area, and an interior stitching attributes for stitching inside the segmental closed area. The line-portion stitching attributes include stitch types for stitching along the segmental outline, for example, running stitch, zigzag stitch, and the like. There are various attribute values for each stitch type. If running stitch is selected as a stitch type, attribute values, such as the number of running stitches, pitch length of running stitches, and the like, may be provided. If zigzag stitch is selected, attributes values, such as the width of zigzag stitches, thread density, and the like, may be provided. Still other line-portion stitching attributes may also be provided, for example, attribute values indicating the color of thread for stitching along the segmental outline.

The interior stitching attributes include stitch types for stitching inside the segmental closed area, for example, satin stitch, tatami stitch, and the like. There are various attribute values for each stitch type. If satin stitch is selected as a stitch type, attribute values, such as the angle of stitch direction, thread density, and the like, may be provided. If tatami stitch is selected, attributes values, such as pitch length of tatami stitch, tatami stitch deviation and the like, may be provided in addition to the attribute values related to satin stitch. Still other interior stitching attributes may also be provided, for example, attribute values indicating the color of thread for stitching inside the segmental closed area.

In this description of the embodiment, it is assumed that, for line-portion stitching attribute, no particular selection is made but predetermined attribute values are used, and that, for interior stitching attributes, the stitch type is preset to satin stitch.

Figure 5:
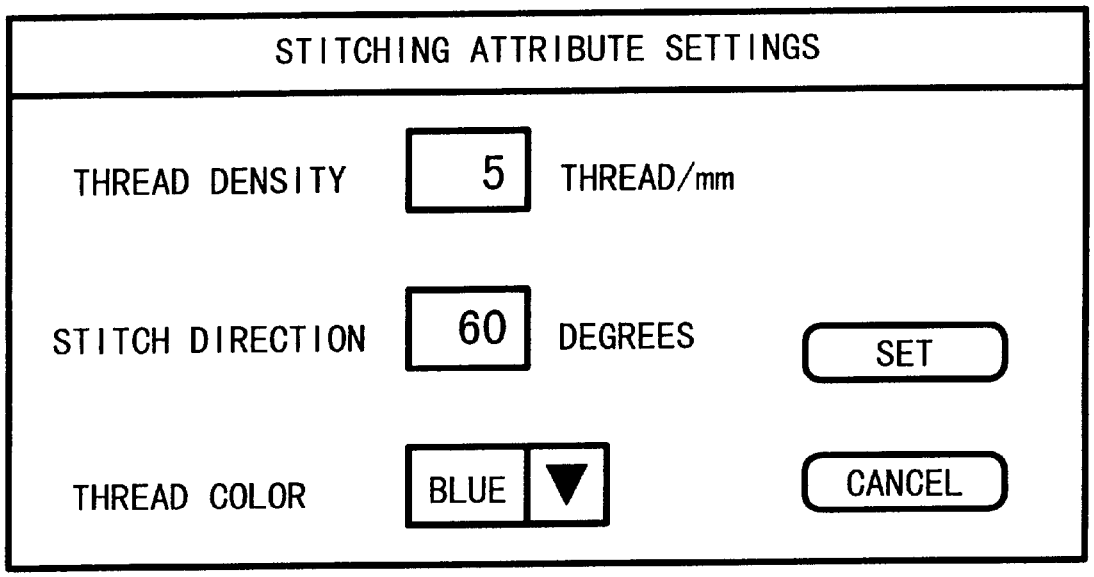
FIG. 5 shows an example of a setting device according to the embodiment.

In the dialog box shown in FIG. 5, the stitching attributes that can be set are thread density, angle of stitch direction, and thread color. For the segmental closed area U1, the user sets attribute values, for example, 5 thread/mm as a thread density, 60 degrees as an angle of stitch direction, and blue as a thread color. The user completes setting by selecting the "SET" button displayed in the dialog box, with the pointer of the mouse 17, and pressing a button of the mouse 17.

The user subsequently sets stitching attributes for other segmental closed areas. The user selects the segmental closed area U2 by touching the segmental closed area U2 on the CRT display 19 using the pointer of the mouse 17, and then pressing the button of the mouse 17. Subsequently, if the segmental closed area U3 is immediately touched by the pointer the mouse 17 and the button of the mouse 17 is pressed, the segmental closed area U3 is selected together with the segmental closed area U2. A plurality of segmental closed areas can thus be selected simultaneously. A picture displayed in a portion of the CRT display 19 when the segmental closed areas U2, U3 are simultaneously selected is shown in FIG. 4C, where a minimum rectangle enclosing the selected segmental closed areas U2, U3 is indicated by a broken line. If a plurality of segmental closed areas are simultaneously selected, it is also possible to set stitching attributes common to the selected segmental closed areas. It is assumed, in this description, that the user selects stitching attributes common to the segmental closed areas U2, U3, for example, 6 thread/mm as a thread density, 150 degrees as an angle of stitch direction, and black as a thread color, in the stitching attribute-setting dialog box, such as shown in FIG. 5.

The stitching attributes of each segmental closed area set as described above can be changed by selecting a desired segmental closed area again in the manner as described above.

Figure 6:
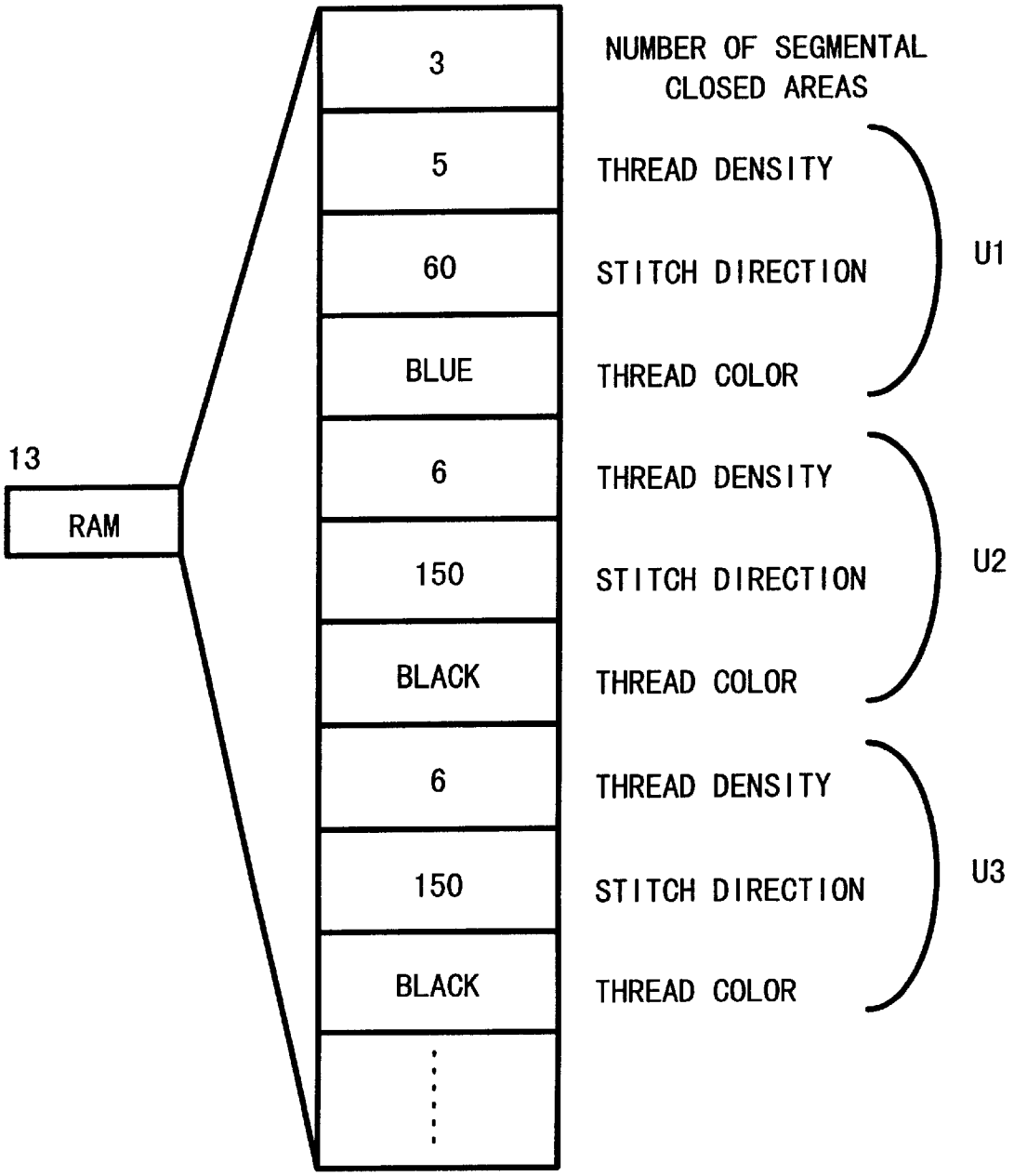
FIG. 6 shows an example of a storage device according to the embodiment.

In step S5, the stitching attributes of each segmental closed area set by the user are stored into the RAM 13. The storage structure for the input data in the RAM 13 is indicated in FIG. 6. The total number of segmental closed areas is first stored into a predetermined address in the RAM 13. Subsequently, the stitching attributes of each segmental closed area, that is, the settings of thread density, angle of stitch direction, and thread color, are serially stored.

Figure 10:
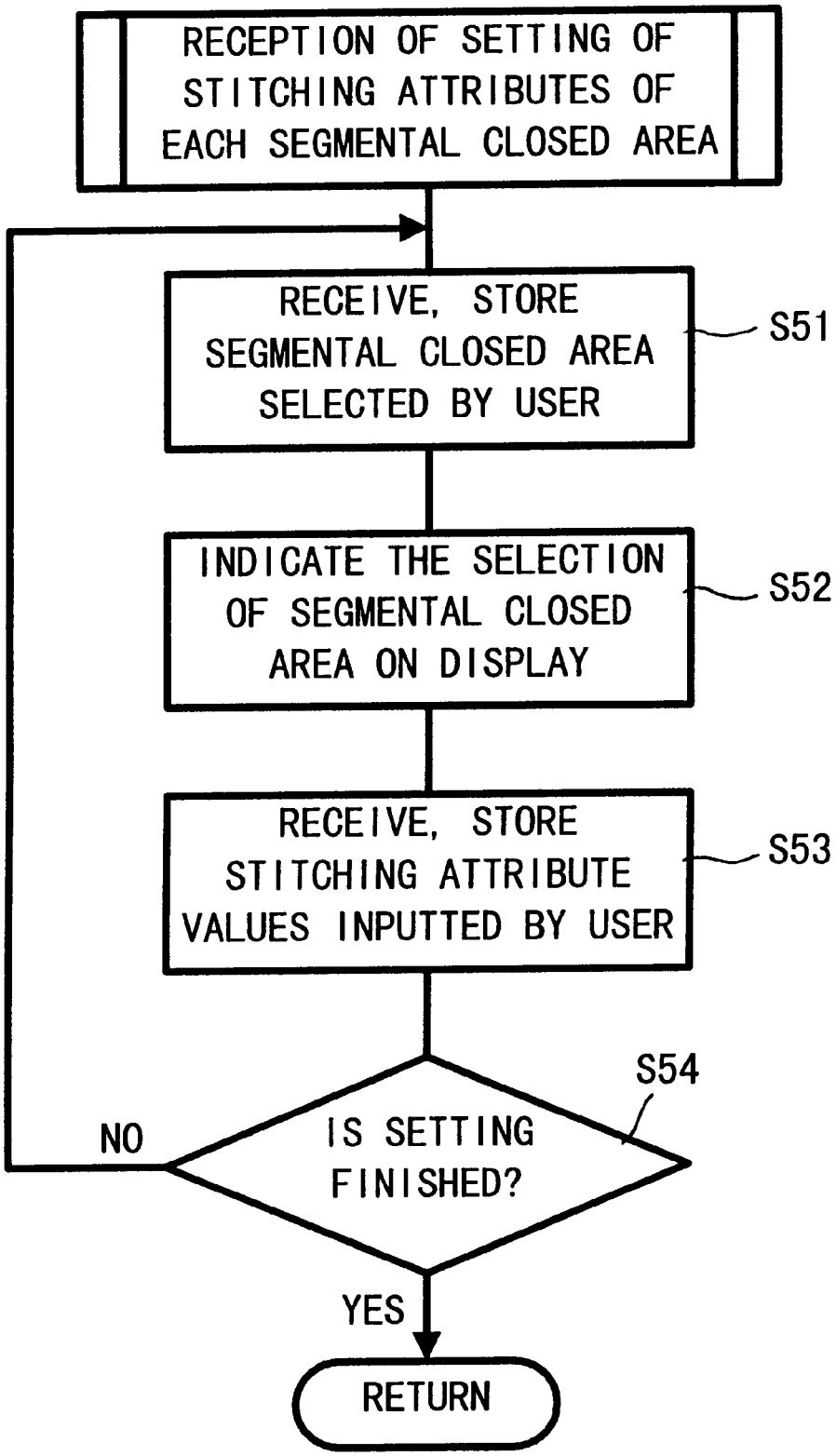
FIG. 10 is a flowchart illustrating an operation of receiving the stitching attributes that are set separately for each segmental closed area by a user.

The operation of step S5, wherein the settings of stitching attribute values of each segmental closed area inputted by a user are received, will be described in detail with reference to the flowchart of FIG. 10.

In step S51, the CPU 11 receives a setting-target segmental closed area that is selected for stitching attribute settings by a user. The user selects a segmental closed area as an area for stitching attribute settings, by touching the segmental closed area on the CRT display 19 using the pointer of the mouse 17 and then pressing the button of the mouse 17. The CPU 11 receives the selected segmental closed area and adds data that identifies the selected segmental closed area, into the RAM 13.

In step S52, the CPU 11 indicates on the CRT display 19 that the segmental closed area selected by the user has actually been selected. That is, if the segmental closed area U1 shown in FIGS. 4A–4C is selected, the CPU 11 indicates the selection by a broken-line rectangle as shown in FIG. 4B.

In step S53, the CPU 11 receives the settings of stitching attributes that are inputted by the user as described above, and stores the attribute values thus set, into the RAM 13. The data storage structure in the RAM 13 is schematically illustrated in FIG. 6.

In step S54, the CPU 11 determines whether to end the setting receiving operation, on the basis of whether the user has finished setting. If the user performs an operation to continue setting attributes, the CPU 11 determines that the attribute setting operation is not finished, that is, the determination in step S54 is NO. The operation then returns to step 51, to continue the operation of receiving the settings of stitching attributes of segmental closed areas. To finish the setting operation, the user inputs an instruction to go to the operation of generating stitch data, using the keyboard 16 or the mouse 17. In response to the input of the instruction, the CPU 11 determines that the stitching attribute-setting operation is finished (Yes in step S54), and goes to step S6 in FIG. 3.

The settings of stitching attribute values set separately for each segmental closed area by a user are thus received and stored by the operation of steps S51–S54.

If the user desires that the settings of stitching attributes be retained in storage even after power-off, it is possible to store the settings into a non-volatile storage medium such as a hard disc.

In step S6, the CPU 11 generates segmental stitch data for the segmental closed area U1, which is indicated by the segmental closed area counter n (=0). Based on the stitching attribute values of the segmental closed area U1 stored into the RAM 13 in step S5, the CPU 11 generates segmental stitch data using a known method of generating stitch data for stitching inside a closed area, which method is employed in a conventional embroidery data processing apparatus.

In step S7, the value of the segmental closed area counter n (=0) is incremented (to n=1). The operation then proceeds to step S8.

In step S8, it is determined whether the value of the segmental closed area counter n equals the total number N of segmental closed areas. Since the current value of the counter n is 1 and the total number N of segmental closed areas is 3, the determination in step S8 is NO, and the operation returns to step S6.

In step S6, the CPU 11 generates segmental stitch data for the segmental closed area U2, which is indicated by the segmental closed area counter n (=1). Based on the stitching attribute values of the segmental closed area U2 stored into the RAM 13 in step S5, the CPU 11 generates segmental stitch data.

In step S7, the value of the segmental closed area counter n (=1) is incremented (to n=2). The operation then proceeds to step S8.

In step S8, it is determined that the value of the segmental closed area counter n (=2) does not equal the total number N (=3) of segmental closed areas. The operation then returns to step S6.

In step S6, the CPU 11 generates segmental stitch data for the segmental closed area U3, which is indicated by the segmental closed area counter n (=2). Based on the stitching attribute values of the segmental closed area U3 stored into the RAM 13 in step S5, the CPU 11 generates segmental stitch data.

In step S7, the value of the segmental closed area counter n (=2) is incremented (to n=3). The operation then proceeds to step S8.

In step S8, it is determined that the value of the segmental closed area counter n (=3) equals the total number N (=3) of segmental closed areas. The operation of generating stitch data is thus completed.

The stitch data thus generated is transmitted to the embroidery sewing machine 25, via the output interface 18 and the communication cable 20 shown in FIG. 2, and then used for embroidery stitching by the embroidery sewing machine 25.

In this embodiment, the operation of step S2 performs a function of a dividing device, and the operation of step S6 performs a function of a segmental stitch data generating device. The RAM 13 performs a function of a storage device. The dialog box for settings of stitching attributes shown in FIG. 5 and the key board 16 perform a function of a stitching attribute setting device. The mouse 17 performs a function of a selecting device.

Although, in the foregoing embodiment, the user is allowed to set only the interior stitching attributes for stitching the interior of each segmental closed area, it is also possible, according to the invention, to allow the user to set line-portion stitching attributes for stitching along a segmental outline that defines a segmental closed area that is selected by the user, in addition to the interior stitching attributes.

Figure 4D:
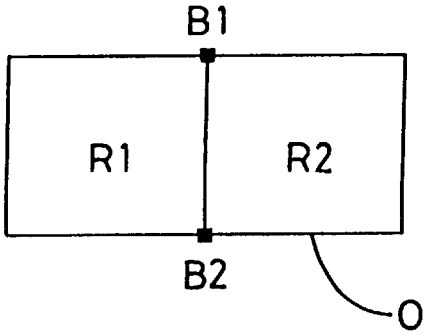

While the foregoing embodiment is described in conjunction with the embroidery area wherein segmental closed areas are interconnected by a single self-intersecting point of the outline L as shown in FIG. 4A, an embroidery area as shown in FIG. 4D can be provided wherein the outline O has self-intersecting points B1, B2 that define a border line between two segmental closed areas R1, R2. For such an embroidery area, the operation of step S2 is also able to set the segmental closed areas R1, R2. Therefore, for segmental closed areas that share a border line instead of "border point", it is also possible to generate stitch data for stitching inside each segmental closed area, with the interior stitching attributes set separately for each segmental closed area, by operation as described above. In addition, for such segmental closed areas, it is also possible to set line-portion stitching attributes separately for each segmental closed area, with respect to the portion of the segmental outline which forms only the segmental closed area, that is, the portion which is not shared with another segmental closed area.

Although, in the foregoing embodiment, the embroidery data processing apparatus generates stitch data, and outputs the data to the embroidery sewing machine, it is also possible to employ an arrangement wherein the embroidery data processing apparatus generates data regarding outlines, stitching characteristics, and the like and outputs the data to the embroidery machine, which generates stitch data based on the data from the embroidery data processing apparatus.

As apparent from the foregoing description, according to the invention, if an outline defining the external shape of an embroidery area has a self-intersecting portion, the dividing device divides the outline into a plurality of segmental outlines using the self-intersecting portion as a boundary. The storage device stores a stitching attribute of the each of segmental closed areas defined by the plurality of segmental outlines. The segmental stitch data generating device generates segmental stitch data for each segmental closed area on the basis of the stitching attribute stored by the storage device. Therefore, the embroidery data processing apparatus of the invention is able to precisely divide the outline having an intersecting portion, into a plurality of segmental outlines, so as to easily generate stitch data for stitching individual segmental closed areas on the basis of the stitching attributes that vary from one segmental closed area to another.

In a preferred embodiment of the invention, the embroidery data processing apparatus further includes a stitching attribute setting device that sets a stitching attribute separately for each segmental closed area. Therefore, it becomes possible to set different stitching attributes for different segmental closed areas, and to generate stitch data based on the different stitching attributes.

In a preferred embodiment, the embroidery data processing apparatus further includes a selecting device that selects at least one segmental closed area from the segmental closed areas. Therefore, it becomes possible to freely select a segmental closed area for setting or changing the stitching attribute, and to correspondingly generating stitch data.

In a preferred embodiment, the stitching attribute of each segmental closed area includes at least one of a line-portion stitching attribute for stitching along the segmental outline and an interior stitching attribute for stitching inside the segmental closed area. Therefore, it becomes possible to set the stitching attribute for stitching along a segmental outline and/or the stitching attribute for stitching inside the segmental closed area independently of each other, and to correspondingly generate stitch data.

In a preferred embodiment, each of the line-portion stitching attribute and the interior stitching attribute includes at least one of a thread color attribute value that defines a color of a thread used for stitching, a stitching type attribute value that defines a type of stitching manner, and an attribute value characteristic of each type of stitching manner. Thereby, it becomes possible to designate in detail the manner of generating stitch data for stitching along a segmental outline and/or for stitching inside the segmental closed area.

It is to be understood that the invention is not restricted to the particular forms shown in the foregoing embodiment. Various modifications and alterations can be made thereto without departing from the scope of the invention encompassed by the appended claims.

What is claimed is:

1. An embroidery data processing apparatus for processing embroidery data for filling a closed area enclosed by an outline that defines a shape of an embroidery area with stitches, comprising:

a dividing device that determines whether the outline has a point at which the outline intersects itself, called a self-intersecting portion, and, when at least one self-intersecting portion exists, divides the outline into a plurality of segmental outlines using the at least one self-intersecting portion as a boundary;

a storage device that stores a stitching attribute of each of segmental closed areas defined by the plurality of segmental outlines; and a segmental stitch data generating device that generates segmental stitch data for each segmental closed area on the basis of the stitching attribute stored by the storage device.

2. The embroidery data processing apparatus according to claim 1, further comprising a stitching attribute setting device that sets a stitching attribute separately for each segmental closed area.

3. The embroidery data processing apparatus according to claim 1, further comprising a selecting device that selects at least one segmental closed area from the segmental closed areas.

4. The embroidery data processing apparatus according to claim 1, wherein the stitching attribute of each segmental closed area includes at least one of a line-portion stitching attribute for stitching along the segmental outline and an interior stitching attribute for stitching inside the segmental closed area.

5. The embroidery data processing apparatus according to claim 4, wherein the at least one of the line-portion stitching attribute and the interior stitching attribute includes at least one of a thread color attribute value that defines a color of a thread used for stitching, a stitching type attribute value that defines a type of stitching manner, and an attribute value characteristic of each type of stitching manner.

6. The embroidery data processing apparatus according to claim 2, further comprising a selecting device that selects at least one segmental closed area from the segmental closed areas.

7. The embroidery data processing apparatus according to claim 2, wherein the stitching attribute of each segmental closed area includes at least one of a line-portion stitching attribute for stitching along the segmental outline and an interior stitching attribute for stitching inside the segmental closed area.

8. The embroidery data processing apparatus according to claim 3, wherein the stitching attribute of each segmental closed area includes at least one of a line-portion stitching attribute for stitching along the segmental outline and an interior stitching attribute for stitching inside the segmental closed area.

9. The embroidery data processing apparatus according to claim 7, wherein the at least one of the line-portion stitching attribute and the interior stitching attribute includes at least one of a thread color attribute value that defines a color of a thread used for stitching, a stitching type attribute value that defines a type of stitching manner, and an attribute value characteristic of each type of stitching manner.

10. The embroidery data processing apparatus according to claim 8, wherein the at least one of the line-portion stitching attribute and the interior stitching attribute includes at least one of a thread color attribute value that defines a color of a thread used for stitching, a stitching type attribute value that defines a type of stitching manner, and an attribute value characteristic of each type of stitching manner.

11. The embroidery data creation device, comprising:

means for determining whether an outline for an embroidery pattern contains at least one self-intersecting point which is a point where the outline crosses itself;

means for dividing the embroidery pattern into at least two closed areas when a self-intersecting point is identified;

means for designating at least one closed area;

means for setting stitch attribute data for the designated at least one closed area; and means for generating stitch data for each closed area based on the set stitch attribute data.

12. The device according to claim 11, wherein the means for determining further determines whether the outline for the embroidery pattern contains common line segments between closed areas.

13. The device according to claim 11, wherein the means for setting stitch attribute data includes means for setting outline stitch data and interior stitch data.

14. The device according to claim 13, wherein the setting stitch attribute data for the outline stitch data includes setting at least a type stitch and a stitch length.

15. The device according to claim 13, wherein the setting stitch attribute data for the interior stitch data includes setting at least a type stitch.

16. A storage medium storing a plurality of programs for setting stitch data for an embroidery pattern, comprising:

a program to identify self intersecting points, a self intersecting point is a point where an outline of the embroidery pattern crosses itself, of an embroidery pattern;

a program to define and count closed areas on the basis of identified self intersection points;

a program to select at least one closed area;

a program to define stitch attributes for the selected at least one closed area; and a program to generate stitch data based on the defined stitch attributes.

17. The storage medium according to claim 17, wherein the program to define stitch attributes includes:

a subroutine for creating outline data; and a subroutine for creating interior stitch data.

18. The storage medium according to claim 17, wherein the attribute data to be input varies in both the subroutine for creating outline data and the subroutine for creating interior stitch data on the basis of a selected stitch type.

* * * * *